166-307

8/1/78 XR 4,103,743 SR

United States Patent [19]

Paul

[11] 4,103,743

[45] Aug. 1, 1978

[54] METHOD AND MEANS OF TREATING WATER WELLS

[75] Inventor: Dwaine M. Paul, Amarillo, Tex.

[73] Assignee: Thomas L. Moran, Amarillo, Tex. ; a part interest

[21] Appl. No.: 736,693

[22] Filed: Oct. 29, 1976

[51] Int. Cl.[2] ..... E21B 37/00; E21B 43/24; E21B 43/27

[52] U.S. Cl. ..... 166/299; 166/53; 166/63; 166/302; 166/207; 166/312

[58] Field of Search ..... 166/299, 302, 307, 311, 166/312, 53, 62, 63, 57

[56] References Cited

U.S. PATENT DOCUMENTS

| | | | |
|---|---|---|---|
| 1,856,912 | 5/1932 | Grebe et al. | 166/299 X |
| 2,732,016 | 1/1956 | MacLeod | 166/63 |
| 2,740,478 | 4/1956 | Greene | 166/299 X |
| 2,756,826 | 7/1956 | Ebaugh | 166/307 |
| 3,012,607 | 12/1961 | DePriester et al. | 166/57 X |
| 3,410,347 | 11/1968 | Triplett et al. | 166/302 X |
| 3,566,970 | 3/1971 | Crow et al. | 166/312 X |
| 3,616,857 | 11/1971 | Pitkethly et al. | 166/299 |
| 3,702,635 | 11/1972 | Farr | 166/299 |
| 3,744,579 | 7/1973 | Godfrey | 166/63 X |
| 3,780,803 | 12/1973 | Hardy et al. | 166/53 X |

OTHER PUBLICATIONS

Bossler et al., "Chemical and Mechanical Treatment of Water-Input Wells," *Secondary Recovery of Oil in the United States*, API, second ed., 1950.

*Primary Examiner*—Stephen J. Novosad
*Assistant Examiner*—George A. Suchfield
*Attorney, Agent, or Firm*—Zarley, McKee, Thomte, Voorhees & Sease

[57] ABSTRACT

A method and means for chemically treating water wells to increase the production thereof. Liquid chemical, usually acid, is initially placed in the well through the water discharge conduit of the well head or pump apparatus at the upper end thereof. Compressed air is initially forced downwardly into the interior of the column pipe in the casing to sense the depth of the water therein so that pressure sensitive gauges in the circuitry may be set according to the water depth. Compressed air is then forced downwardly into the column pipe to force some of the water outwardly therefrom into the water bearing formation. A combustible mixture of air and gas is then introduced into the upper end of the column pipe and ignited so that the force of combustion expels the water and acid in the casing outwardly through the slits in the well casing into the water bearing formation. The heated gases of combustion cool rapidly and the combustion step is repeated approximately 200–300 times over a period of approximately three hours. The heat of combustion increases the temperature of the water and acid to approximately 108° F which enhances the action of the acid. The impact of combustion also tends to loosen or break any encrustation which is present in the water bearing formation. The well is then pumped for approximately 2 to 3 hours to remove the acid and residue therefrom.

6 Claims, 3 Drawing Figures

METHOD AND MEANS OF TREATING WATER WELLS

BACKGROUND OF THE INVENTION

Water bearing sands around irrigation wells often become clogged with formations comprised of carbonates (usually manganese or calcium), as well as iron and hydroxides. The clogging of the sands as described above is ordinarily called encrustation. Encrustation of the water bearing sands seriously reduces the productivity or capacity of the well and many attempts have been made to treat these wells with acid to bring the carbonates, etc. into solution so that the well will no longer be clogged. Surfactants (wetting agents) have also been used in an attempt to facilitate the breakdown of the carbonates.

In the conventional treatment of the wells, it has been necessary to pull the well (pump apparatus) from the casing. Dynamite has also been used in an attempt to force the acid into the formations but the top of the well must be sealed when this is done. Additionally, dry ice has been dumped into the wells with the well then being sealed so that the carbon dioxide will create pressure to force the acid bearing water into the sands.

The above-described methods have been generally satisfactory but are time consuming and expensive due to the need for removing the pump apparatus from the casing. Further, the existing methods do not achieve desirable efficiency.

Therefore, it is a principal object of the invention to provide an improved method and means for forcing an acid-water mixture into water bearing sands around an irrigation well or the like.

A further object of the invention is to provide a method and means for chemically treating water wells by means of heat injection and impact.

A further object of the invention is to provide a method and means for chemically treating water wells which does not require that the pump apparatus be removed from the well.

A further object of the invention is to provide a method and means for treating water wells which efficiently reduce the encrustation of water bearing sands around a water well.

A still further object of the invention is to provide a method and means for chemically treating water wells which is efficient and economically practical.

These and other objects will be apparent to those skilled in the art.

DESCRIPTION OF THE PREFERRED METHOD AND EMBODIMENT

Figure 1:
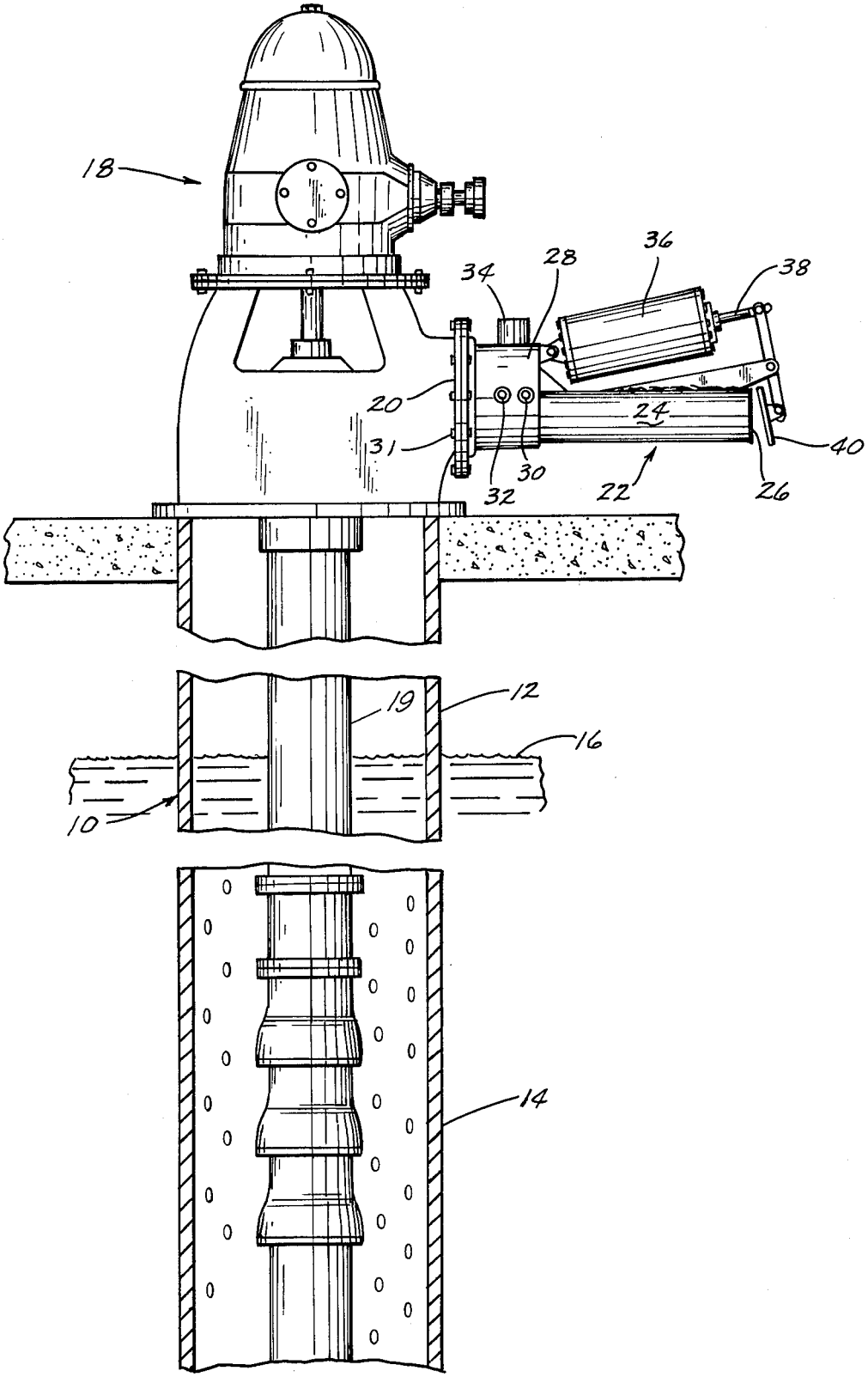
FIG. 1 is a partial side view of a typical water well having a portion of the means for practicing the invention mounted thereon.
Figure 2:
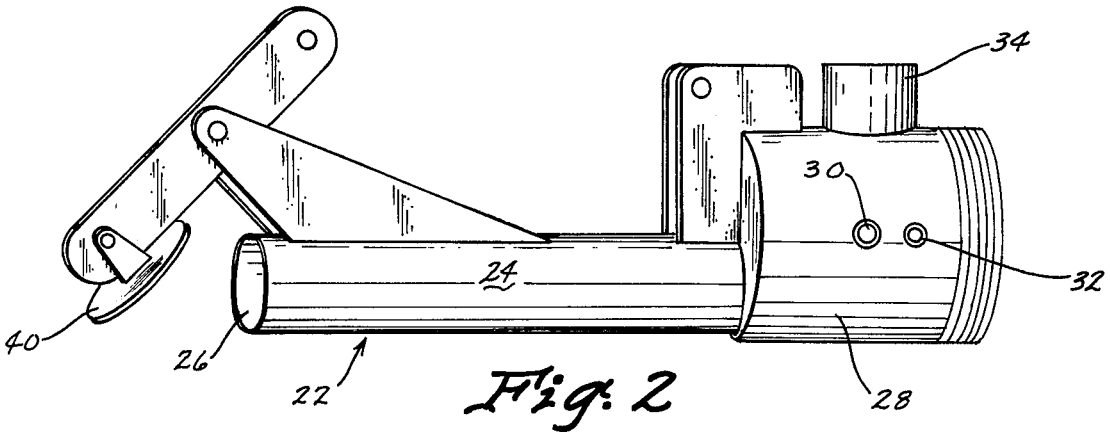
FIG. 2 is a partial perspective view of the gas discharge valve which is mounted on the well head.

The numeral 10 refers generally to a well casing including an upper portion 12 and a lower perforated portion 14. The perforated portion 14 is usually provided at the lower end of the casing for a distance of 30 to 90 feet. The static water level within the casing 10 is represented by the reference numeral 16. A pump apparatus 18 is provided on the upper end of the casing 10 and generally comprises a column pipe 19 having conventional impellors at the lower end thereof. Pump apparatus 18 would normally discharge the water through the flanged discharge opening 20 which normally has a water discharge pipe secured thereto. In those gear heads not having a draw down hole, one must be provided to permit the escape of gases therethrough. The numeral 22 refers generally to an exhaust valve which is secured to the flanged opening 20 as illustrated after the water discharge pipe has been removed therefrom. Valve 22 comprises an elongated hollow pipe 24 having an open end 26. The other end of pipe 24 is in communication with a larger pipe portion 28 which is secured to the flanged opening 20 by bolts 31. Pipe portion 28 is provided with pipe fittings or couplers 30, 32 and 34 as seen in FIG. 1. Cylinder 36 is operatively mounted on pipe 24 and pipe portion 28 and has its cylinder rod 38 connected to a valve member 40 which is adapted to close the open outer end of pipe 24 upon extension of the rod 38 with respect to the cylinder.

Figure 3:
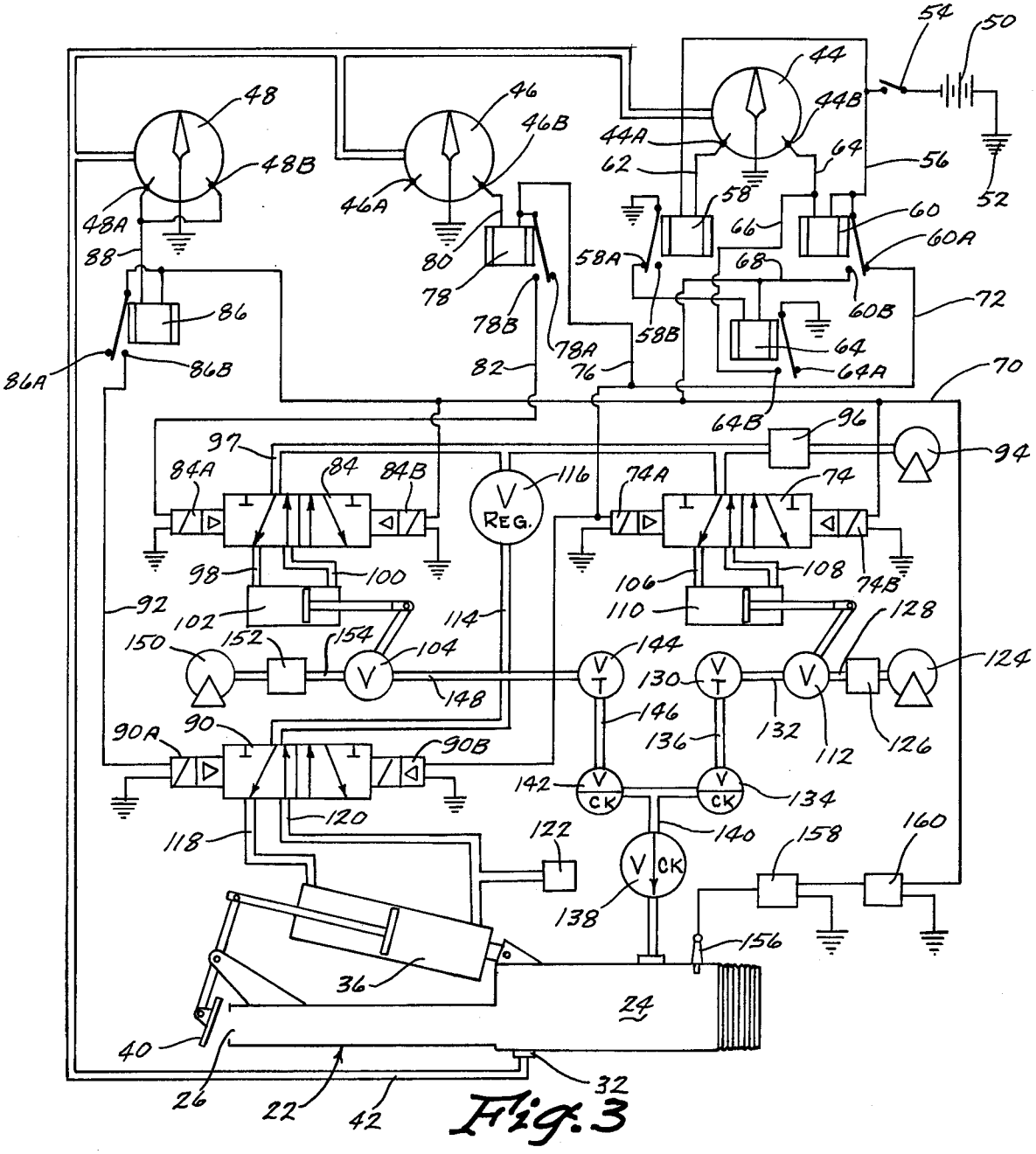
FIG. 3 is a schematic view of the circuitry of the invention.

FIG. 3 schematically illustrates the circuitry for achieving the before-stated objectives. As seen in FIG. 3, pipe 42 is secured to coupler 32 and is in communication with pressure sensitive switches 44, 46 and 48. Pressure sensitive switches 44, 46 and 48 are manufactured by Frank W. Murphy, Inc. of Tulsa, Okla., and are designated Model OPL-160SS and which have exterior adjustably upper and lower limit contacts. The adjustment of the contacts on the three gauges provides the programming of the assembly for various wells of different depth and static water levels. For purposes of description, gauges 44, 46 and 48 will be described as including contacts 44A and 44B, 46A and 46B, and 48A and 48B, respectively.

The source of electrical power for the apparatus is referred to by the reference numeral 50 and is preferably a 12 volt battery with one terminal at ground 52. Switch 54 is provided between battery 50 and lead 56 as seen in FIG. 3. Lead 56 is electrically connected to relays 58 and 60. Relay 58 is connected to contact 44A by lead 62. Relay 60 is connected to contact 44B by lead 64. Relay 58 is provided with contacts 58A and 58B while relay 60 is provided with contacts 60A and 60B. Contact 58A is electrically connected to relay 64 including contacts 64A and 64B. Lead 66 connects lead 64 to contact 64B. Lead 68 connects contact 60B to relay 64 and is connected to lead 70. Lead 72 connects contact 60A to solenoid 74A of valve 74 which also has solenoid 74B on the other end thereof. Lead 76 connects lead 72 to relay 78 having lead 80 connected to contact 46B. Relay 78 includes contacts 78A and 78B as seen in FIG. 3.

Lead 82 is electrically connected to contact 78B and to solenoid 84A of valve 84 which also has solenoid 84B at the other end thereof. As seen in FIG. 3, lead 70 is also connected to relay 86 including contacts 86A and 86B. Lead 88 connects relay 86 to contact 48A of gauge 48. Lead 86B is connected to solenoid 90A by lead 92. Solenoid 90A is provided on one end of valve 90 which also includes solenoid 90B.

The numeral 94 refers to an air compressor for supplying air at 125 p.s.i. to valves 74, 84 and 90 through the tank 96. Lines 98 and 100 are connected to the opposite ends of cylinder 102 which is mechanically connected to the valve 104 as illustrated. Lines 106 and 108 connect valve 74 to the opposite ends of cylinder 110 which is mechanically connected to the valve 112 for operating the same. Line 114 is in communication with the line 97 and has regulator valve 116 imposed therein. Line 114 is connected to valve 90 which has lines 118 and 120 extending therefrom connected to opposite ends of the cylinder 36. Air tank 122 is in communication with line 120 as seen in FIG. 3.

The numeral 124 refers to a high volume, single stage, low pressure compressor connected to the tank 126. Tank 126 is in communication with the valve 112 by means of line 128. Valve 112 is connected to throttle valve 130 by line 132. As illustrated, throttle valve 130 is connected to check valve 134 by line 136. Check valve 134 is connected to check valve 138 by line 140. Check valve 142 is also connected to check valve 138 by line 140. Check valve 142 is connected to throttle valve 144 by line 146. As depicted, throttle valve 144 is connected to valve 104 by line 148. Gas compressor 150 supplies gas to tank 152 which is connected to valve 104 by line 154.

Ignition plug 156 is mounted on pipe 24 so that the contacts thereof are in communication with the interior thereof. Ignition plug 156 is electrically connected to a high voltage generator 158 which is electrically connected to a time delay 160 electrically connected to the lead 70.

Liquid chemical, usually acid, is initially placed in the well through the water discharge conduit of the well head or pump apparatus at the upper end thereof. The apparatus is then programmed for a particular well as follows: the adjustable contacts on switch gauges 44, 46 and 48 are initially backed away so that contact will not be made at any point on the scale of the gauges. Compressor 94 is activated so that pressure is available to valves 74, 84 and 90. Switch 54 is closed momentarily to permit current to flow through the contacts 60A of relay 60 to solenoid 74A of valve 74 and to solenoid 90B of valve 90 which causes valve 112 to open and which causes valve member 40 to close.

Switch 54 is then opened and compressor 124 is started. Throttle valve 130 is manually opened so that air from compressor 124 flows through tank 126, valve 112, valve 130, check valve 134, check valve 138 and valve 22 into column pipe 19.

Pressure is allowed to build within column pipe 19 of the pump. The pressure pushes the water downwardly to the bottom of the column pipe. The compressed air then escapes through the water and the pressure registered on switch gauge 44 will cease to rise. At this point, contact 44B of switch gauge 44 is adjusted to push the indicator hand of switch gauge 44 down 1 p.s.i. on the pressure indicator scale so that contact will be made at that particular pressure. The point on the scale of switch gauge 44 at which contact is made by 44B will hereinafter be referred to as the "firing pressure."

The following adjustments are then made on the switch gauge contacts of switch gauges 46 and 48. The contact 48A of switch gauge 48 is set at 5 p.s.i. below the firing pressure previously established. Thus, when combustion gases have cooled to allow a pressure drop of 5 p.s.i., contact will be made at 48A, hereinafter this pressure will be referred to as the "exhaust pressure." Contact 48B of switch gauge 48 is set at 50 p.s.i. above the firing pressure and will hereinafter be called the "safe pressure." Contact 44A of switch gauge 44 is set at one half of the firing pressure and will hereinafter be referred to as the "recycle pressure." Contact 46B of switch gauge 46 is set at a point on the scale which is equal to the recycle pressure plus one half the differential between the recycle pressure and the firing pressure and will hereinafter be referred to as the "gas injection pressure."

As previously stated, the regulator valve 116 is a high volume, controlled outlet pressure valve that is adjusted to allow enough pressure to cylinder 36 so that normal combustion pressure in valve 22 will not override its power. The air in cylinder 36 backs into tank 122 in a condition of above normal combustion pressure, and valve 22 relieves pressure within column pipe 19 of the pump.

The hand controlled throttle valve 144 is adjusted to allow approximately 10 percent of as much gas to flow through it as air flows through throttle valve 130 since 10 percent is a combustible mixture. At this time, compressor 94 and compressor 124 will be running. Compressor 124 is delivering compressed air to the column pipe 19 and the pressure is holding the contacts 44B closed on switch gauge 44.

Switch 54 is closed again and gas compressor 150 is activated. Since contact is being made at 44B of switch gauge 44, current flows through the coil of relay 60 to open the contact 60A and to close the contact 60B. Current now flows through the coil of relay 64 and through contacts 58A of relay 58 to ground. Contacts 64B of relay 64 are now closed and ground is held to the coil of relay 60, thus holding contacts 60B of relay 60 closed. Current is now flowing to the time delay 160 of the ignition system. Current is flowing to solenoid 74B of valve 74 and valve 112 is closed. Current is flowing to solenoid 84B of valve 84 and valve 104 closes so that gas is not yet been permitted to enter column pipe 19. Current is available to the coil of relay 86 but no ground has yet been made through contacts 48A of switch 48.

Hot compressed air was previously delivered into column pipe 19 from compressor 94 and the small receiving tank 96. As the air cools, the pressure drops within the column pipe 19 and this drop is transmitted through pipe 42 to switch gauges 44, 46 and 48. When the pressure has dropped 5 p.s.i., contact is made at 48A of switch gauge 48 and relay 86 closes contacts 86B. Current then flows to solenoid 90A of valve 90 and valve 22 opens. Compressed air now escapes rapidly from column pipe 19 and when recycle pressure is reached, contacts 44A of switch gauge 44 close and current flows through the coil of relay 58. Contacts 58A of relay 58 now open and no ground is available to the coil of relay 64. Contacts 64B of relay 64 open and no ground is available to the coil of relay 60. Contacts 60B of relay 60 open and contacts 60A close.

Current is flowing to solenoid 74A of valve 74 and valve 112 opens. Current is flowing to solenoid 90B of valve 90 and valve 22 closes. Compressed air is flowing into column pipe 19 and pressure is building. Current is available to the coil of relay 78 and when gas injection pressure is reached, ground is made to the coil of relay 78 through contacts 46B of switch gauge 46. Contacts 78B of relay 78 close and current flows to solenoid 84A of valve 84 and valve 104 opens.

The compressed air passing through check valve 138 and the gas going through check valve 138 mix and go past ignition plug 156 into column pipe 19 of the pump. The mixture forces the air or exhaust gases retained in column pipe 19 from the previous cycle to the bottom of the column pipe 19. The air or exhaust gas from the previous cycle acts as a buffer and is compressed during combustion.

When pressure within column pipe 19 reaches firing pressure, the results are as described heretofore when switch 54 is closed. At this same time, current is made available to the time delay switch 160 and then to high voltage generator 158, which causes an electrical arc on the points of ignition plug 156. The time delay 160 permits valves 130 and 144 to close before ignition.

The entire process repeats automatically at a speed depending on the depth and size of column pipe 19 and the supply of compressed air and gas. Combustion pressure may be regulated by raising or lowering recycle pressure with an adjustment of contact 44A of switch gauge 44. It may also be regulated by adjusting contact 46B of switch gauge 46.

It is preferred that approximately 200 to 300 ignitions or combustions be delivered to the formation for a period of two or three hours. Liquid chemical, usually acid, would have been previously placed in the well and the forces of combustion force the water and acid mixture outwardly through the perforations of the well casing into the water bearing sands extending around the casing. The impact of the water and acid mixture into the water bearing sands tends to disintegrate or break up the encrustation therein. Additionally, the repeated combustion causes the temperature of the water and acid mixture to rise to about 108° F and the increased temperature of the mixture also enhances the chemical reaction within the water bearing sands.

After the desired number of ignitions have occurred, the well is pumped for approximately two to three hours to remove the acid and residue therefrom. The valve 22 would then be removed from the pump and the conventional water discharge conduit replaced thereon.

In summary, the method steps are as follows:

(1) Liquid chemical, usually acid, is placed in column pipe 19.

(2) Compressed air is forced downwardly into column pipe 19 to force some of the water outwardly therefrom into the water bearing formation.

(3) A combustible mixture of air and gas is introduced into the upper end of the column pipe 19.

(4) Ignition occurs in pipe 24 which is in communication with pipe 19 so that the air and gas mixture in pipe 19 is combusted or ignited.

(5) The force of combustion in pipe 19 expels the water and acid in casing 14 outwardly through the slits in in the well casing 14 into the water bearing formation.

(6) The heated gases of combustion cool rapidly and the combustion step is repeated approximately 200–300 times over a period of approximately three hours.

(7) The well is then pumped for approximately 2 to 3 hours to remove the acid and residue therefrom.

Thus it can be seen that a unique method and means has been provided to inject heat and impact into a well by combustion means, for the purpose of speeding chemical reaction time and forcing chemicals into tight formation. It can also be seen that the above-described method can be accomplished without pulling the well pump which results in a considerable savings of time and money.

Thus it can be seen that the method and means accomplishes at least all of its stated objectives.

I claim:

1. The method of treating water wells having a column pipe positioned within a perforated casing and a pump apparatus at the upper end thereof, comprising the steps of:

placing a liquid chemical in the column pipe, sealing the upper end of the column pipe, injecting compressed air into the upper end of the column pipe, injecting a combustible mixture of gas and air into the upper end of the column pipe, and igniting the gas-air mixture whereby the pressure combustion will force a portion of the water and liquid chemical in the column pipe and casing outwardly through the perforations in the casing into the water bearing formation around said casing.

2. The method of claim 1 wherein said ignition is repeated at predetermined intervals for a predetermined length of time.

3. The method of claim 2 wherein the gases of combustion are exhausted outwardly from the upper end of the column pipe between ignitions.

4. The method of claim 2 wherein said air and said gas-air mixture is introduced into the column pipe at predetermined pressures to achieve controlled combustion pressures.

5. The method of claim 2 wherein said ignitions are repeated sufficiently close together to cause the water-chemical mixture to rise to approximately 100° F.

6. An apparatus for treating a water well including a perforated casing, a pump apparatus at the upper end of said casing, and a column pipe extending downwardly from said pump apparatus through said casing, comprising, an exhaust valve at the upper end of said column pipe in communication with the interior thereof, means for supplying compressed air to the interior of said column pipe, means for supplying a gas-air mixture to the interior of said column pipe, ignition means at the upper end of said column pipe for igniting the gas-air mixture within the column pipe, and control means for sequentially closing said exhaust valve to supply compressed air at a predetermined pressure to said column pipe; for supplying the gas-air mixture to the interior of said column pipe at a predetermined mixture and pressure; for igniting the gas-air mixture; and for opening said exhaust valve to permit the exhaust gases to escape after combustion.

* * * * *